US005438473A

United States Patent [19]

Allina

[11] Patent Number: 5,438,473

[45] Date of Patent: Aug. 1, 1995

[54] VARISTOR CONNECTION AND USAGE

[76] Inventor: Edward F. Allina, 605 Capri Blvd., Treasure Island, Fla. 33706

[21] Appl. No.: 129,448

[22] Filed: Sep. 30, 1993

[51] Int. Cl.[6] ..... H01C 7/12

[52] U.S. Cl. ..... 361/118

[58] Field of Search ..... 361/56, 91, 127, 111, 361/118; 338/21

[56] References Cited

U.S. PATENT DOCUMENTS 3,768,058 10/1973 Harnden, Jr. ..... 338/20

*Primary Examiner*—A. D. Pellinen
*Assistant Examiner*—Michael Sherry
*Attorney, Agent, or Firm*—Charles A. McClure

[57] ABSTRACT

Varistors with modified response are made by rearrangement of electrical conductors in contact with them as on a circuit board. The rearrangement involves graduated separation of hot and ground leads so as to provide graduated paths through the varistors. The resulting circuit boards are useful in transient voltage surge suppression (TVSS), such as between a watt-hour meter and its socket for protection of the meter and downstream electrical equipment.

12 Claims, 2 Drawing Sheets

VARISTOR CONNECTION AND USAGE

TECHNICAL FIELD

This invention relates to electrical connection to varistors so as to modify their non-linear current response to applied voltage, as is especially useful in transient voltage surge suppression (TVSS) means and methods.

BACKGROUND OF THE INVENTION

Varistors are commonly made by sintering particulate metal oxides, with or without minor amounts of other inorganic materials, as in disk or rod form. They have non-linear electrical resistance over a range of applied voltages, often only slightly conductive at customary power line voltage but increasingly conductive at higher voltages. Varistors are frequently interposed between an upstream power source and downstream electrical equipment powered from that source for protection of such load equipment against over-voltages.

In TVSS applications varistors function by shunting to ground the brief but extremely high currents resulting from transient voltage spikes often present on the power lines, such as may result from lightning or faulty switching. For examples, see my U.S. Pat. Nos. 4,866,560; 4,901,187; 4,907,119; and 4,931,895; which illustrate diverse arrangements of varistors providing TVSS.

Sintered varistor compositions are so hard that it is hardly practical to subdivide such a structure into thin wafer-like units. In conventional practice, particulate constituents are die-pressed together into individual self-supporting form and then are sintered. An alternative is the so-called "thick film" varistor, which is formed in place from similar particulate material, whether dry or in paste form, as on a non-conductive substrate, which also usually carries connecting terminals. In such varistors electrical conduction occurs mainly along—rather than perpendicular to—the thin varistor dimension. Examples of such varistors in U.S. patents are disclosed by Jefferson in U.S. Pat. No. 3,916,366 and also by Aoki et al. in U.S. Pat. No. 4,333,861; whereas examples of suitable varistor compositions appear in such U.S. Pat. Nos. as 4,045,374; 4,211,994; and 4,794,048. See also Harnden U.S. Pat. No. 3,818,411 for graduated varistor structures.

SUMMARY OF THE INVENTION

A primary object of the present invention is to modify varistor response to transient voltage surges by rearrangement of electrical connectors to varistors.

Another object of this invention is to connect varistors on a circuit board for better transient voltage surge suppression (TVSS).

A further object is to provide varistors for interconnection with a plurality of phase lines on a single circuit board carrying TVSS circuitry.

In general the objects of the present invention are attained by providing patterned electrical interconnection, characterized by graduated spacing, with varistors on a non-conductive substrate.

More particularly, one or more varistors are connected between a first or "hot" connector and a ground connector, usually via a circuit board or similar substrate, and the respective connectors are patterned so that the intervening varistor conduction path varies in graduated manner. It will be understood that the voltage drop along the conduction path is a function of the length of the path, whereas the current accommodated is a function of the path cross-section.

Other objects of the present invention, together with means and methods for attaining the various objects, will be apparent from the following description and accompanying diagrams of preferred embodiments, which are presented by way of example rather than limitation.

DESCRIPTION OF THE INVENTION

Figure 1A:
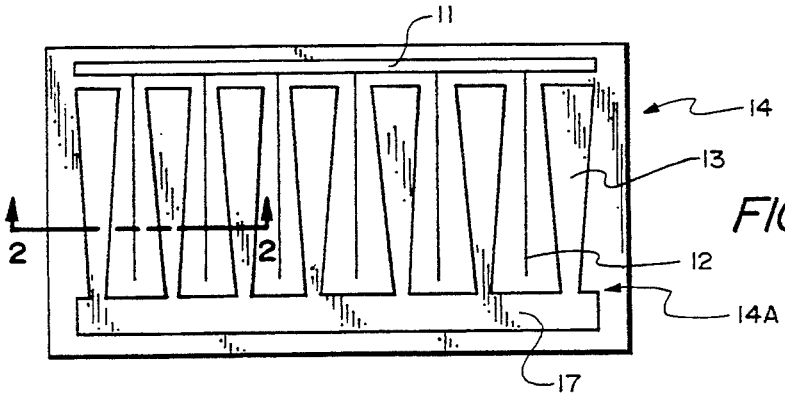
FIG. 1A is a top plan view of a circuit board illustrating one pattern of electrical connectors useful according to this invention.
Figure 1B:
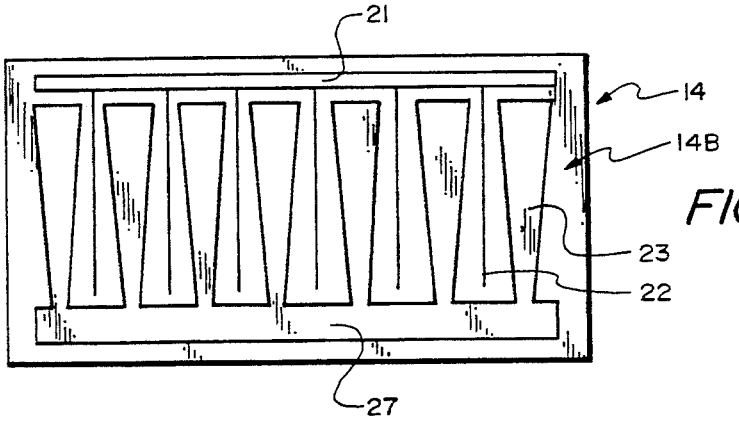
FIG. 1B is a bottom plan view of the same circuit board with similarly patterned electrical connectors thereon.

FIGS. 1A and 1B show respective top and bottom faces 14A and 14B of substrate or circuit board 14. Upper or top face 14A of the board bears narrow prospectively electrical phase-connected or "hot" laminar terminal strip 11 extending lengthwise of the board near one long edge. Half dozen mutually parallel narrower laminar conductors 12, spaced evenly apart, extend widthwise from the terminal strip across most of the face of the board without contacting any other conductors. Wider prospectively grounded laminar terminal strip 17 parallels the opposite lengthwise edge of the board, and from it seven laminar conductors 13 extend widthwise (perpendicular thereto) interleaved with narrowest conductors 12, each of which consequently is flanked by a pair of these larger conductors 13. Each latter conductor 13 is triangular in plan, with a narrow truncated end at its connection to ground terminal strip 17 and gradually increasing width toward a maximum at its far end, which nears but is spaced from hot terminal strip 11.

Lower or bottom face 14B of same circuit board 14 mirrors upper or top face thereof. Narrow lengthwise laminar hot terminal strip 21 parallels one long edge, and from it six narrower laminar conductors 22 extend perpendicularly across most of the width of the board. Wide laminar ground terminal strip 27 parallels the board's opposite long edge, and from this strip seven triangular laminar ground conductors 23 extend interleaved parallel to and spaced from narrow laminar conductors 22, each of which is consequently flanked by a pair of such triangular ground conductors 23. As shown below in FIG. 4, terminal strips 11 and 21 are prospectively connectable to external power source phase leads, and terminal strips 17 and 27 are prospectively connectable to an external ground lead.

Figure 2:
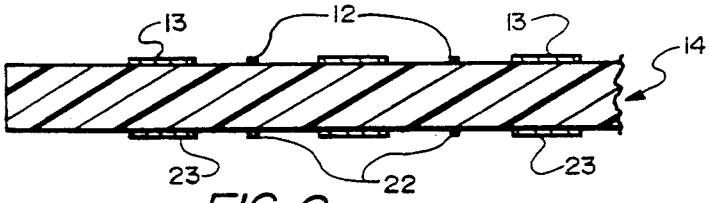
FIG. 2 is a sectional elevation through the circuit board of FIGS. 1A and 1B, taken as indicated at 2—2 on FIG. 1A.

FIG. 2 shows, in transverse section along II—II on FIG. 1A, a representative portion of circuit board 14 before superimposition of varistor material. Respective upper and lower faces 14A and 14B of the board exhibit crosswise sections of narrow upper and lower hot conductors 12 and 22, respectively, alternating with and spaced from respective upper and lower wider ground conductors 13 and 23.

Figure 3:
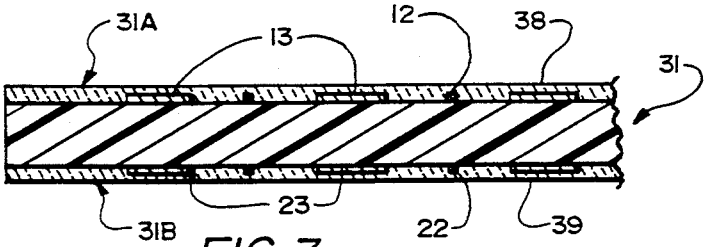
FIG. 3 is a similar sectional elevation of such circuit board after superimposition of varistors on the top and bottom faces.

FIG. 3 is a similar view to FIG. 2 except for superimposition of upper layer 31A and lower layer 31B on the respective top and bottom faces of the resulting coherent varistor circuit board 31. The varistor material covers the exposed faces of the laminar conductors and preferably also fills the recesses between the conductor edges.

Figure 4:
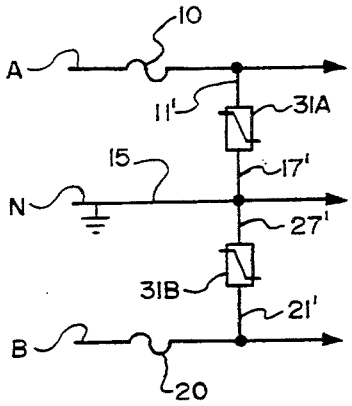
FIG. 4 is a schematic diagram of an example of TVSS (transient voltage surge suppression) circuitry with the resulting varistors.

FIG. 4 shows, in electrical schematic form, respective remote power source phase leads A and B provided with over-current fuses 10 and 20 therein, and neutral (N) ground lead 15. Arrowheads on the lines point in the downstream direction, where electrical load equipment (not shown here) is located to be powered through these leads. Each phase line has a varistor 31 connected between it and ground. Interconnecting lead 11' connects from phase line A to terminal strip 11 of upper face 31A of varistor circuit board 31, whose ground terminal strip 17 is connected by lead 17' to neutral line 15, which is grounded. Interconnecting lead 21' connects from phase line B to terminal strip 21 of lower face 31B of varistor circuit board 31 whose ground terminal strip 27 is connected by lead 27' to grounded line 15 (N).

Figure 5:
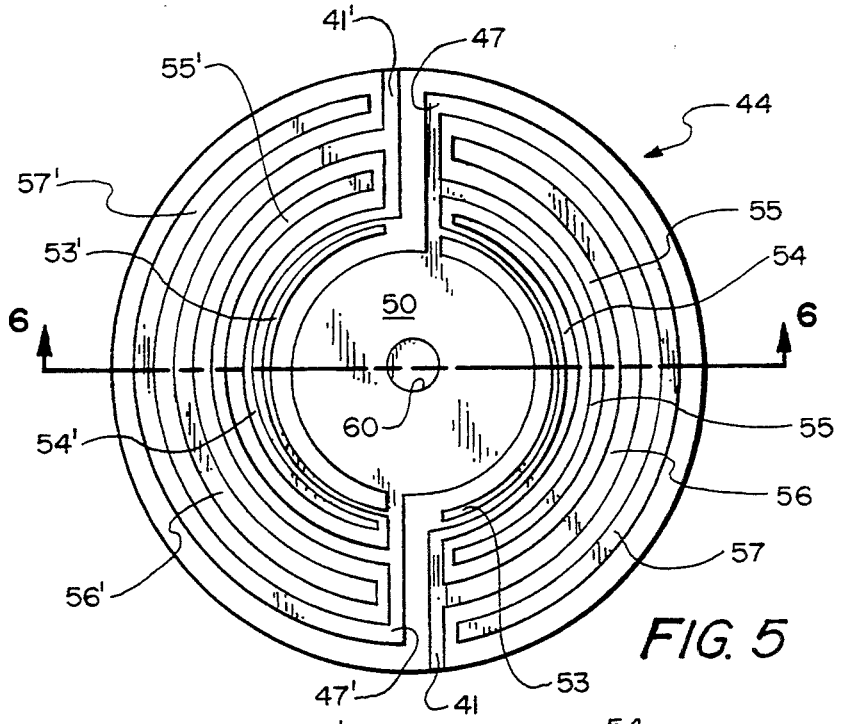
FIG. 5 is a plan view of a circular circuit board provided with patterned electrical connectors according to this invention.

FIG. 5 shows in plan a face of circular circuit board 44 having arcuate, more specifically semicircular, laminar conductors thereon. Each of the right and left halves of the board surface has a radial hot terminal strip, 41 for the right half and 41' for the left half. Inner conductor 54 and outer conductor 56 extend semicircularly from hot radial terminal strip 41, while inner 53, intermediate 55, and outer 57 conductors extend semicircularly from radial terminal strip 47, which terminates at core conductor 50, which central opening 60. Similarly on the left half of circuit board 44, Inner conductor 54' and outer conductor 56' extend semicircularly from hot radial terminal strip 41', while inner 53', intermediate 55', and outer 57' conductors extend semicircularly from radial terminal strip 47', which terminates at core conductor 50 having central opening 60.

Figure 6:
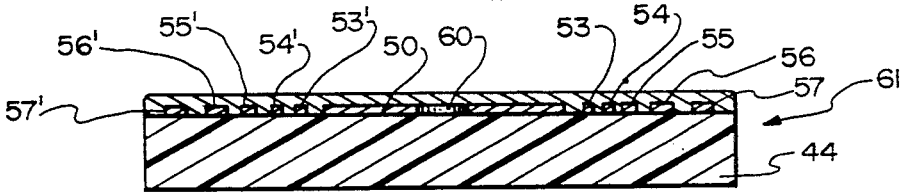
FIG. 6 is a sectional elevation taken as indicated at 6—6 made from the circuit board of FIG. 5.

FIG. 6 shows in sectional elevation the circuit board of FIG. 5 here designated varistor board 61 having layer of varistor material overlying and filling in between the various terminal strips and semicircular conductors tied thereto on substrate 44. This section emphasizes the increasing size and spacing of the semicircular conductors (53, 54, 55, 56, 57 at the right and 53', 54', 55', 56' 57') from the portion surrounding core 50 to the outer edge of the board. Thus, the embodiment of FIGS. 5 and 6 provides in one face what the previously illustrated embodiment requires two faces to provide, for a single-phase electrical circuit, which requires two phase lines.

Figure 7:
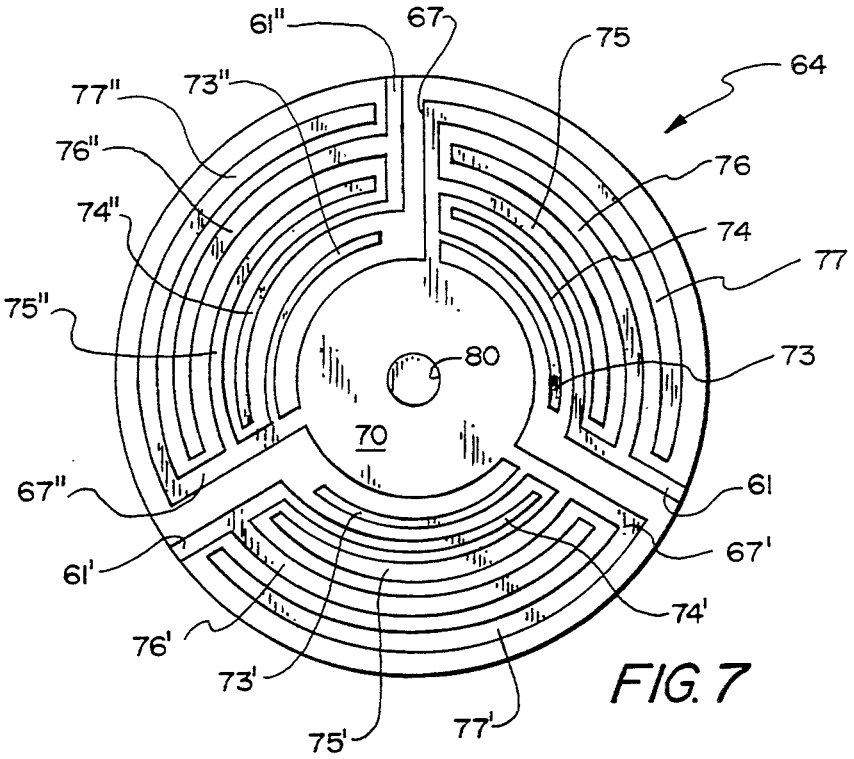
FIG. 7 is a sectional elevation through a three-phase circuit board patterned for a three-phase varistor board.

FIG. 7 shows in plan a three hot terminal three-phase analog 64 of the two hot terminal single-phase circuit board of FIGS. 5 and 6. Instead of subdivision of the circle into halves, here the circle is divided into thirds, three sectors of 120 degrees each, with a like central ground as in the single-phase embodiment. The upper right sector has radial hot terminal 61 with arcuate conductors 74 and 76 extending therefrom and has radial ground terminal 67 connected to core conductor 70 having central opening 80, with arcuate conductors 73, 75, and 77 extending from the radial ground terminal. Similarly The next clockwise sector sector has radial hot terminal 61' with arcuate conductors 74' and 76' extending therefrom and has radial ground terminal 67' connected to core conductor 70, with arcuate conductors 73', 75', and 77' extending from the radial ground terminal. Also similarly, the upper left sector has radial hot terminal 61'' with arcuate conductors 74'' and 76'' extending therefrom and has radial ground terminal 67'' connected to core conductor 70, with arcuate conductors 73'', 75'', and 77'' extending from the radial ground terminal. It will be apparent that this circuit board embodiment can be converted to a three-phase TVSS varistor circuit board just as the previous single-face embodiment was converted, and be connected to a four-wire (three phases plus ground) power source.

To facilitate circuit connections, the circuit boards may be provided with protruding terminals or edge connectors, but they are omitted in these diagrams for simplicity of the illustrations. The varistor material is contiguous with the conductors and terminals.

It will be understood that a transient voltage surge appearing between either power phase line and ground produces a current surge through the corresponding varistor to ground, whereupon the voltage downstream of the varistors is substantially undisturbed, so does not affect the load equipment adversely as the surge voltage might have done if it had proceeded downstream instead of being clipped by such varistor. TVSS apparatus including such varistors so connected may be installed at the conventional watt-hour meter, as in a meter adapter that plugs between the meter and its conventional socket, or at a weatherhead upstream of the meter, or at a control box or panel downstream of the meter but upstream of equipment to be protected.

For any given varistor composition the distance through which a surge will send an electrical current is the chief indicator of the boundary between shunted and unshunted surge voltages. The area of varistor through which current may flow is the chief indicator of how much current the varistor will accommodate and still funvtion. If a varistor overhears from conducting too much current, it may run away to very high current flows and temperatures, and self-destruct.

Conventional varistors have a characteristic voltage at which they begin to conduct sufficiently that they effectively preclude higher transient voltage from proceeding downstream, sometimes known as the "clamping voltage." If that voltage is too low, the varistor may be subject to destructive overheating as it shunts currents from all higher voltages through itself to ground, but if that voltage is too high, the varistor may permit damaging surge voltages to proceed downsream and risk damage to some delicate electrical equipment.

The present invention provides, in effect, a graduated clamping voltage or succession of clamping voltages, thereby eliminating both mentioned disadvantages of conventional varistor circuits. Part of the path through the varistors is short, whereupon smaller surges are shunted to ground than are usually excluded from proceeding downstream, to the bendfit of downstream equipment. As surge voltages rise, they can follow longer paths through the varistor so can be conducted through larger cross-sections, as will be necessary to prevent overheating. In the first embodiment of this invention the path increase is provided by a widening of the lateral gap between narrow hot conductors and ground connectors tapering away therefrom.

In the second embodiment of this invention the lengthening of the path is provided by increased radial thickness of and spacing between successive arcuately extending interleaved hot and ground conductors. In both embodiments the conduction is sideways through a varistor, rather than perpendicularly through its thickness as is more customary in conventional practice. However, the length of the conductors is so great as to abut a considerable varistor area, more than is customarily available in conventional disklike varistors.

This invention can be practiced with apparatus and compositions readily available from commercial sources. Non-conductive substrates for circuit boards are provided by numerous suppliers of electronic materials. Many, if not most, varistor manufacturers prefer to sell pre-packaged varistors, but bare varistors can be obtained from Panasonic in circular disk configuration, and perhaps flame-spray and others forms. Suitable particulate oxides of zinc and other metals, are available from INCO Specialty Powder Products, Saddle Brook, N.J. Flame spray apparatus useful with varistor precursor compositions is available from from Miller Thermal, Inc. of Appleton, Wis. For flame spray and other methods of making thick-film varistors as precursors to varistor circuit boards see my concurrent patent application Ser. No.

Whereas a circuit board as substrate has been illustrated with conductive terminals pre-attached thereto, terminals can be added as may be desired, and/or connections may be made to the exterior face of a resulting thick-film varistor, if preferred. The substrate is preferably made of a thermosetting resin, such as an acetal or epoxy or a phenol or melamine formaldehyde condensation product, with or without reinforcing fibers of glass or other compatible material.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

I claim:

1. Transient voltage surge suppression (TVSS) apparatus, comprising a two-faced varistor-carrying circuit board having distinct laminar electrical conductors spaced apart on a face thereof, covered by contiguous varistor material, including a plurality of terminal strips, and associated with each terminal strip a plurality of conductive strips extending from conductive contact therewith, the conductive strips from the respective terminal strips being mutually interleaved so that the spacing of their respective adjacent edges from one another increases from the vicinity of one terminal strip to another terminal strip.

2. TVSS apparatus according to claim 1, wherein the circuit board is rectangular and each face having respective terminals being adapted to be connected between a respective phase lead and ground.

3. TVSS apparatus according to claim 1, wherein said interleaved strips are confined to a proportionate part of the face area, and the terminals being adapted to be connected between respective phase leads and ground.

4. TVSS apparatus according to claim 3, wherein the varistor region of the board is circular, the terminals are oriented radially and have circumferentially extending interleaved laminar conductors.

5. Transient voltage surge suppression (TVSS) apparatus, comprising a rectangular laminar non-conductive substrate having two opposite faces, at least one face carrying these laminar structures:

a first conductive terminal strip paralleling one side edge of the rectangular substrate face in a plane continuous with the face, a first plurality of coplanar mutually parallel conductive strips spaced laterally apart and extending from conductive contact with the first terminal strip across part of the face, a second conductive terminal strip paralleling the opposite side edge of the rectangular substrate face in the same plane, a second plurality of coplanar mutually parallel conductive strips spaced laterally apart and extending from conductive contact with the second terminal strip and across part of the face, the first and second mutually parallel conductive strips being covered with varistor material and interleaved with and spaced laterally from one another and also being spaced laterally apart and lengthwise apart from conductive contact with the terminal strip for the other parallel strips.

6. TVSS apparatus according to claim 5, wherein both faces carry like laminar structures.

7. TVSS apparatus according to claim 5, wherein the second mutually parallel conductive strips are wider than the first ones.

8. TVSS apparatus according to claim 7, wherein the first mutually parallel conductive strips are connected through their terminal strip to an electrical source phase line, and wherein the second mutually parallel conductive strips are connected through their terminal strip to ground.

9. Transient voltage surge suppression (TVSS) apparatus, comprising a circular laminar non-conductive substrate having a face carrying these laminar structures:

a first conductive terminal strip extending radially from the outer edge of the substrate face and contiguous therewith, a first plurality of coplanar mutually parallel conductive strips spaced laterally apart and extending from conductive contact with the first terminal strip arcuately across part of the face, a second conductive terminal strip extending radially from a remote part of the outer edge of the substrate face and contiguous therewith, a second plurality of coplanar mutually parallel conductive strips spaced laterally apart and extending from conductive contact with the second terminal strip arcuately across part of the face, the first and second pluralities of arcuate conductive strips being covered with varistor material and interleaved with and spaced laterally from one another and also being spaced radially apart and also apart from conductive contact with the terminal strip for the other plural strips.

10. TVSS apparatus according to claim 9, wherein the spacing of the pluralities of arcuate conductive strips increases with their radial distance from the center of the circular substrate.

11. TVSS apparatus according to claim 9, including a third plurality of similar arcuate conductive strips, wherein each of the pluralities of conductive strips with their respective radial terminal strips occupies a proportionate portion of the circular face.

12. TVSS apparatus according to claim 11, adapted to three-phase operation, with a separate circuitry phase on a single face subdivided into three sectors, one for each phase.

* * * * *